United States Patent [19]

Yoshimura

[11] 4,354,078

[45] Oct. 12, 1982

[54] ILLUMINATING TYPE PUSH BUTTON SWITCH

[75] Inventor: Sumio Yoshimura, Sekimachi, Japan

[73] Assignee: Sun Dengyosha Company, Limited, Tokyo, Japan

[21] Appl. No.: 210,392

[22] Filed: Nov. 25, 1980

[30] Foreign Application Priority Data

Feb. 13, 1980 [JP] Japan ..... 55-15575

[51] Int. Cl.[3] ..... H01H 9/16; H01H 9/02; H01H 5/06

[52] U.S. Cl. ..... 200/314; 200/67 B; 200/296; 200/340

[58] Field of Search ..... 200/310, 314, 67 B, 200/340, 296

[56] References Cited

U.S. PATENT DOCUMENTS

| | | | |
|---|---|---|---|
| 3,114,805 | 12/1963 | Baumer | 20/67 B |
| 3,681,552 | 8/1972 | Bailey | 200/314 |
| 3,773,999 | 11/1973 | Groezinger | 200/314 |
| 4,004,120 | 1/1977 | Lee | 200/310 |
| 4,096,368 | 6/1978 | Grebner | 200/314 |
| 4,268,735 | 5/1981 | Iwakiri | 200/314 |

OTHER PUBLICATIONS

Tateishi Denki K.K. Catalogue dated Feb., 1980.

*Primary Examiner*—John W. Shepperd
*Attorney, Agent, or Firm*—Wenderoth, Lind & Ponack

[57] ABSTRACT

The present invention discloses an illuminating type push button switch using a lamp and microswitches secured adjacent to each other on a bottom plate of a casing to shorten the depth of the illuminating push button switch. ON-OFF control of the microswitches is carried out by a push member supported on the casing so as to be movable heightwise relative to the casing, thereby providing rigidity as well as good strength and rendering positive switching operation of the switch possible.

7 Claims, 9 Drawing Figures

ILLUMINATING TYPE PUSH BUTTON SWITCH

BACKGROUND OF THE INVENTION

The present invention relates to illuminating type push button switches, and more specifically to an illuminating type push button switch in which a lamp is used as an illuminating source and microswitches are used as a switch mechanism.

A conventional illuminating type push button switch using a lamp is designed so that in consideration of strength, service life or the like of the switch mechanism and in consideration of readiness of assembling operation and replacement of the lamp, the switch mechanism and a lamp mounting portion are positioned longitudinally apart from each other. Thus, such a conventional illuminating type push button switch has the disadvantage that the depth thereof is relatively great.

SUMMARY OF THE INVENTION

A primary object of the present invention is to provide an illuminating type push button switch in which a lamp and microswitches are disposed adjacent to each other on a bottom plate of a casing in an effort to shorten the depth of the switch. According to the characteristic feature of the present invention, the illuminating type push button switch comprises a casing in which microswitches and a lamp socket are housed so that they are positioned adjacent to each other, a push member supported movably heightwise relative to the casing and associated with the microswitches to effect ON-OFF control thereof, and a lamp supported in the lamp socket. It is a further object of the present invention to provide an illuminating type push button switch using a lamp in which the lamp can be replaced readily without removing the lamp socket itself. It is another object of the present invention to provide an illuminating type push button switch using a lamp in which a coil spring is used which forms one of the constitutional elements of the microswitch to thereby provide good strength. It is still another object of the present invention to provide an illuminating type push button switch using a lamp in which the operation of the push member is transmitted to the microswitches by a ⊐-shaped actuator whereby even if the microswitch has its contact in the form of a multicontact, all contacts can be accurately actuated at the same time. It is a further object of the present invention to provide an illuminating type push button switch using a lamp in which a fixing member is fitted and supported on the outer surface of the casing so that it may be secured to a mounting plate or the like in an easy and rigid manner.

BRIEF DESCRIPTION OF THE DRAWINGS

The drawings show one embodiment in accordance with the present invention in which.

DETAILED DESCRIPTION OF THE INVENTION

Figure 1:
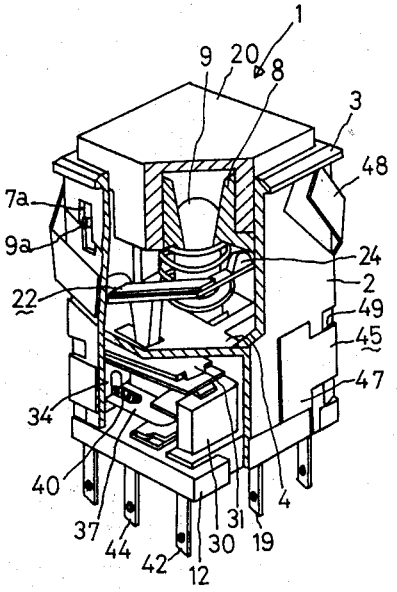
FIG. 1 is a partially cutaway perspective view showing the entire structure.
Figure 2:
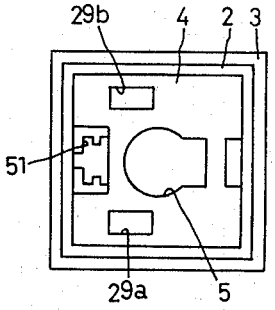
FIG. 2 is a plan view of a casing.
Figure 3:
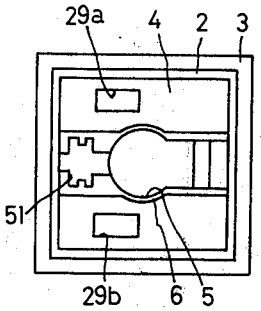
FIG. 3 is a bottom view of the casing.
Figure 4:
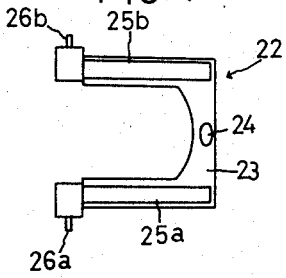
FIG. 4 is a plan view of an actuator.
Figure 5:
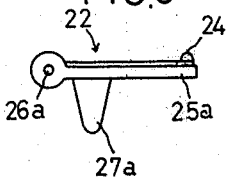
FIG. 5 is a front view of the actuator.
Figure 6:
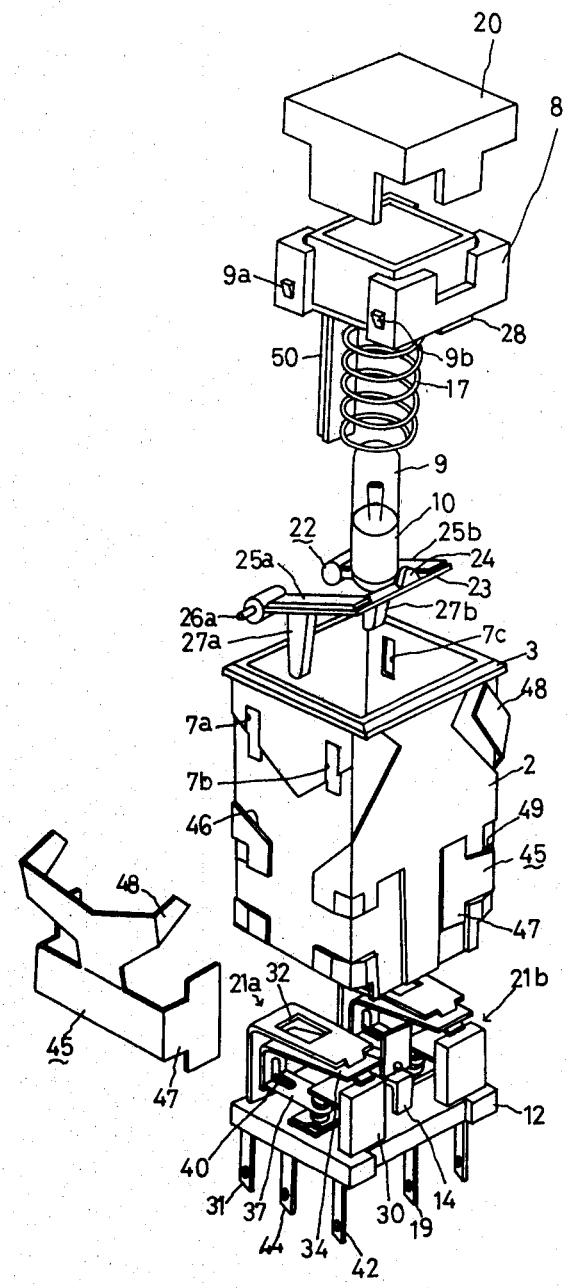
FIG. 6 is an exploded view of the entire structure.
Figure 7:
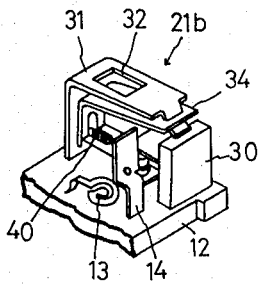
FIG. 7 is a partially cutaway view showing the arrangement of a helical contact member disposed on a bottom plate, a contact plate and microswitches.
Figure 8:
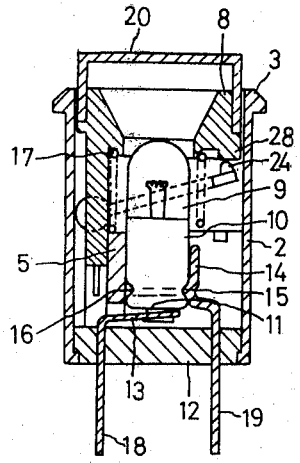
FIG. 8 is a sectional view of a central portion showing the arrangement of a lamp.
Figure 9:
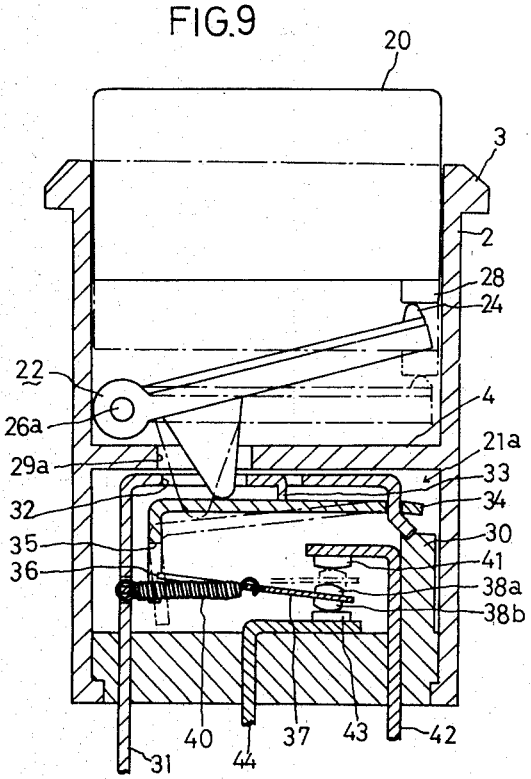
FIG. 9 is a sectional view showing a microswitch.

One embodiment of the present invention will be described with reference to FIGS. 1 to 9.

Reference numeral 1 designates an illuminating type push button switch, and a casing 2 having generally rectangular sides therefor is formed of a suitable material such as plastics or the like. A flange portion 3 is formed on the upper end of the casing 2. The casing 2 is internally provided with a support plate 4, in a central portion of which is formed a passage 5 in the shape in which a rectangle is continuous to a part of a circle. The support plate 4 is provided with a cylindrical support member 6 as a lamp support member having a notch along the passage 5. In upper portions of a pair of sides of the casing are respectively formed pairs of slots **7*a*, 7*b* and 7*c*** (one of which is invisible).

Reference numeral 8 designates a push member, and a pair of sides thereof are respectively provided with pairs of guide pawls **9*a* and 9*b* (those on one side are invisible). The push member 8 is supported movably up and down in the casing 2 by inserting the guide pawls 9*a* and 9*b* into the corresponding slots 7*a*, 7*b* and 7*c*. Reference numeral 9 designates a lamp having a base 10 which is fitted and supported in the cylindrical support member 6. A bottom terminal 11 of the lamp 9 resiliently bears on a flat spring 13 formed of a suitable electrically conductive material in the form of a lamp bottom terminal contact plate secured to a bottom plate 12. Reference numeral 14 designates a contact plate formed of an electrically conductive material having a suitable resiliency, which is positioned corresponding to a notch in the cylindrical support member 6, inclined inwardly of the cylindrical support member 6 and resiliently bears on the base 10. Reference numeral 15 designates a projection provided on the contact plate 14, which is fitted into a groove 16 to positively hold the lamp 9. Reference numeral 17 designates a coil spring, which is arranged slightly spaced from the peripheral surface of the lamp 9, the coil spring having an upper end adapted top bear on the push member 8 and a lower end to bear on the support plate 4 to resiliently upwardly urge the push member 8. The aforesaid cylindrical support member 6, contact plate 14 and helical spring 13 constitute a lamp socket. Reference numeral 18 designates an extgernal terminal connected to the flat spring 13, 19 an external terminal connected to the contact plate 14, and 20 a style strip covering the push member 8. The bottom plate 12 is provided with two microswitches 21*a* and 21*b* in such a manner as to position the helical flat spring 13 and contact plate 14** therebetween.

Reference numeral 22 designates an actuator having a ⊐-shaped configuration and made of plastics or the like. A projection 24 is provided on the upper surface of a lateral rod 23 of the actuator 22, and shafts **26*a* and 26*b* are respectively provided on the outer surfaces of the foremost ends of a pair of side rods 25*a* and 25*b*. Also, operating members 27*a* and 27*b* are respectively provided on the lower surfaces of the side rods 25*a* and 25*b*. The actuator 22 is pivotally supported within the casing 2 by the shafts 26*a* and 26*b*, and the range of upward pivotal movement thereof is controlled by contact of the projection 24 with a projected portion 28 formed on the push member 8. The operating members 27***a* and 27*b* are extended downward through holes 29*a* and 29*b* formed in the support plate 4 into abutment with a switch closing member of micro-switches 21*a*, 21*b*, thus effect switching of the switches 21*a* and 21*b*.

The construction of the microswitches 21*a* and 21*b* will be described hereinafter in detail. Since these microswitches 21*a* and 21*b* are the same in construction, only one microswitch will be described. Reference numeral 30 designates a fixed bed suspended from the bottom plate 12, to which is secured a bent end of a substantially L-shaped common terminal 31 whose horizontal end is bent downward, the common terminal 31 having a vertical end extended outwardly from the bottom plate 12. A hole 32 is formed directly under the hole 29*a* of the support plate 4 in the common terminal 31, and the operating member 27*a* is further projected downward through the hole 32. Also, the common terminal 31 is formed with a downwardly bent projected member 33. Reference numeral 34 designates as switch closing L-shaped movable member, a horizontal end of which is pivotally fitted and supported on the bent end of the common terminal 31. The movable member 34 is formed at its vertical end with a vertically extending inverted U-shaped notch 35 and with an engaging groove 36 which extends horizontally and which has its central portion cut away by notch 35. Reference numeral 37 designates a flat plate as a conventional plate, one end of which has upper and lower surfaces formed with contacts 38*a* and 39*b*. The flat plate 37 is formed at the other end with an inverted U-shaped notch 39 and fitted and engaged at the other end in the engaging groove 36. Reference numeral 40 designates a coil spring which is arranged to correspond to each of the notches 39 and 35, one end of the coil spring being secured to a forwardmost edge of notch 39 while the other end extends below engaging groove 36 in notch 35 and is secured to the common terminal 31. Reference numeral 41 designates a normally open contact positioned above the contact 38*a* and secured to a normally open terminal 42 which extends through the bottom plate 12. Reference numeral 43 designates a normally closed contact positioned below the contact 38*b* and secured to a normally closed terminal 44 which extends through the bottom plate 12.

Reference numeral 45 designates a fixing member formed from a metal plate formed after the shape of a recess 46 formed on an outer surface of the casing 2 and comprises a fitting element 47 and a fixed element 48. Recesses 46 are providced in a pair of opposed sides of casing 2. Each recess 46 extends transversely and upwardly bifurcatedly, the transversely extended portion being extended toward the other pair of adjacent outer sides and having a vertically extending portion when reaching the end, the upwardly bifurcatedly extending portion being extended toward the other pair of adjacent outer sides until it reaches the upper end of the casing 2. The fitting element 47 is provided to fit and support the fixing member 45 in the recess 46 of the casing 2 and is provided at both ends with extensions vertically extended to fit into vertically extending portions at the ends of the transversely extending portions of recess 46. Since a corner 49 of the casing is obliquely cut as is apparent from FIG. 1, the fitting element 47 may be smoothly forced into the recess 46. On the other hand, the fixed element 48 is formed at the upper edge with fine concavoconvexes (not shown), and when the casing 2 is mounted on a mounting plate (not shown), the concavoconvex is bitten into the mounting plate whereby the casing 2 may be firmly fixed on the mounting plate.

In the drawings, reference numeral 50 designates an operating plate for stabilizing the push member 8 and used for the alternate action of the push button switch 1, and 51 denotes a hole through which the operating plate 50 is inserted.

Next, the operation of the above-described structure will be described.

When the style strip 20 is forced downward against the resilient force of the spring 17, the projection 24 of the actuator 22 bearing on the projected portion provided on the push member 8 is pivotally moved downward. The actuator 22 is pivotally moved downward about the shafts 26*a* and 26*b*, and the operating members 27*a* and 27*b* of the actuator 22 are moved downward. The movement of the operating members 27*a* and 27*b* causes the downward pivotal movement of the movable member 34 of each of the microswitches 21*a* and 21*b* about the fitted portion at the extremity of the common terminal 31. At this time, the flat plate 37 is pulled toward the normally closed contact 43 under the influence of the biasing force of the coil spring 40. However, when the position of the engaging groove 36 is displaced to a point lower than the position of the coil spring 40 by pivotal movement of the movable member 34, the biasing force of the coil spring 40 is exerted in a direction of raising the flat plate 37 and thus, the contact 38*a* bears on the normally open contact 41.

Next, when the push member 8 is released, the push member 8 is returned upward under the influence of the resilient force of the coil spring 40, and the upward force is applied to the movable member 34 under the influence of the coil spring 40. Therefore, the actuator 22 is forced upward, and when the position of the engaging groove 36 is at a point above the coil spring 40, the flat plate 37 is pulled downward and the contact 38*b* is returned to bear on the normally closed contact 43.

As described above, in the above-described embodiment, the microswitches and the illuminating lamp socket are arranged in parallel on the bottom plate 12 to thereby reduce the depth of the illuminating push button switch to a degree of the order of $\frac{1}{2}$ to $\frac{2}{3}$ of prior art switches. Further, the operation of the push member 8 is transmitted by use of the ⊐-shaped actuator 22 whereby the operation of two microswitches may be effected positively and simultaneously. Moreover, since the push member 8 has four guide pawls 9*a* and 9*b*, even if the style strip 20 is depressed in any position thereof, push member 8 will be moved downward in parallel fashion with less inclination of the push member 8. Even if this movement of the push member 8 should be effected while being inclined, inclination of the push member 8 is absorbed because the arrangement wherein the projection 24 of the actuator 22 bears on the projected portion 28 of the push member 8, thus having no influence on the operation of the two microswitches. Since two side levers 25*a* and 25*b* of the actuator 22 pivot about the shafts 26*a* and 26*b* to apply pressure due to the push member 8 to a point of the projection 24 of the lateral lever 23 from the top, the operating members 27*a* and 27*b* of the side levers 25*a* and 25*b* always can be maintained at the same level to render simultaneous operation of two microswitches 21*a* and 21*b* possible. Furthermore, the actuator 22 is in the form of a ⊐-shaped so that two side levers are inwardly bent and therefore, the actuator 22 may be mounted readily and a space within the ⊐-shaped contour can be advantgeously used for arrangement of the lamp 9.

Moreover, where the microswitches as in the present embodiment are used, the coil spring 40 instead of a flat spring or the like is used for the microswitch itself whereby the strength is increased to sufficiently withstand the finger pressure, thus rendering the miniaturization of the present switch possible. Also, the illuminating lamp may be replaced by removing the style strip 20 and pulling out the illuminating lamp 9 or inserting the lamp 9 into the cylindrical support member 6 while spreading the contact plate 14. This method of replacement offers labor-saving as compared with the case of a prior art arrangement in which the illuminating lamp socket is pulled out to remove the lamp, after which the socket is mounted. Further, since the fixing member 45 is employed in the present embodiment, the push button switch 1 may be firmly secured to the desired mounting plate (not shown) by the spring action of the fixing element 48. This fixing operation can be further positively accomplished by the provisions of fine concavoconvexes on the upper edge of the fixing element 45. With this, the push button switch 1 is never moved from the mounting plate during use and does not rattle and can be used for a long period of time.

As described above, in accordance with the present invention, there are various advantages that the depth of the illuminating push button switch using a lamp may be shortened to miniaturize the switch, that the switch is simple and rigid in construction, that the switch has a prolonged service life and is easy to assemble, that the lamp can be replaced easily and that the function of the switch is accurate and smooth.

What is claimed is:

1. An illuminating type push button switch comprising:

a casing having a bottom plate;

microswitches mounted on said bottom plate;

a lamp socket supporting a lamp, said lamp socket being positioned laterally adjacent said microswitches and comprising a lamp support member at a position spaced upwardly from said bottom plate, a contact plate having a first end inclined inwardly toward said lamp support member and a second end connected to an external terminal, and a lamp bottom terminal contact plate disposed on said bottom plate directly beneath said lamp support member;

a push member mounted for heightwise movement relative to said casing; and an actuator mounted on said casing to be operated by said push member and in abutment with said microswitches to achieve ON-OFF control of said microswitches in response to said heightwise movement of said push member.

2. A switch as claimed in claim 1, wherein said lamp support member is formed in a support plate of said casing spaced above said bottom plate.

3. A switch as claimed in claim 1, wherein said lamp bottom terminal plate is supported resiliently on a flat spring connected to an external terminal.

4. An illuminating type push button switch comprising:

a casing having a bottom plate;

microswitches mounted on said bottom plate;

a lamp socket supporting a lamp and positioned laterally adjacent said microswitches;

a push member mounted for heightwise movement relative to said casing;

an actuator mounted on said casing to be operated by said push member and in abutment with said microswitches to achieve ON-OFF control of said microswitches in response to said heightwise movement of said push member; and each said microswitch comprising normally open and normally closed contacts mounted on said bottom plate in opposed relation with a predetermined vertical space therebetween, a fixed bed support on said bottom plate, a substantially L-shaped common terminal having a first end extending through said bottom plate to the exterior of said casing and a second end secured to said fixed bed, an L-shaped movable member extending along said common terminal and having a first end pivotally supported on said common terminal and a second end having formed therein a longitudinally extending notch and a laterally extending engaging groove, a conductive plate having at a first end thereof a pair of contacts positioned between said normally open and normally closed contacts and in second end thereof a longitudinally extending notch, said second end of said conductive plate being fitted and engged with engaging groove of said movable member, and a coil spring having a first end secured to an innermost edge defining said notch of said conductive plate and a second end secured to said common terminal and extending through said notch in said movable member at a position thereof beneath said engaging groove.

5. An illuminating type push button switch comprising:

a casing having a bottom plate;

microswitches mounted on said bottom plate;

a lamp socket supporting a lamp and positioned laterally adjacent said microswitches;

a push member mounted for heightwise movement relative to said casing; and an actuator mounted on said casing to be operated by said push member and in abutment with said microswitches to achieve ON-OFF control of said microswitches in response to said heightwise movement of said push member, said actuator having a substantially ⊐-shaped configuration formed by a pair of side rods joined by a transverse rod, said actuator being mounted for vertical pivotal movement in said casing by means of shafts on said pair of side rods, said transverse rod having on the upper surface thereof a projection in abutment with said push member, whereby said heightwise movement of said push member causes said actuator to pivot vertically about said shafts, and said side rods having on lower surfaces operating members in abutment with said microswitches.

6. An illuminating type push button switch comprising:

a casing having a bottom plate;

microswitches mounted on said bottom plate;

a lamp socket supporting a lamp and positioned laterally adjacent said microswitches;

a push member mounted for heightwise movement relative to said casing;

an actuator mounted on said casing to be operated by said push member and in abutment with said microswitches to achieve ON-OFF control of said microswitches in response to said heightwise movement of said push member;

said casing being defined by a first pair of rectangular, spaced, parallel walls and a second pair of rectangular, spaced, parallel walls, said first pair of walls each having formed the outer surface thereof a recess having opposite lateral portions joining upwardly inclined first recesses in outer surfaces of said second pair of walls and joining second recesses having vertical projections in said outer surfaces of said second pair of walls; and a pair of fixing members for mounting said casing, each said fixing member being fitted in a said recess in the respective wall of said first pair of walls, and each said fixing member having opposite lateral fitting elements extending into said respective said second recesses in said second pair of walls and opposite lateral fixed elements extending into respective said first recesses in said second pair of walls, said elements being upwardly inclined.

7. A switch as claimed in claims 1, 4, 5 or 6, wherein spaced parallel walls of said casing have therein heightwise extending slots, and said push member has extending therefrom pawls slidably fitting into said slots, thereby guiding heightwise movement of said push member with respect to said casing.

* * * * *